US005931416A

United States Patent [19]

Carpenter

[11] Patent Number: 5,931,416

[45] Date of Patent: Aug. 3, 1999

[54] TETHERED AIRCRAFT HAVING REMOTELY CONTROLLED ANGLE OF ATTACK

[76] Inventor: Howard G. Carpenter, 7667 Kelley Dr., Apt. 13, Stockton, Calif. 95207

[21] Appl. No.: 08/976,125

[22] Filed: Nov. 21, 1997

[51] Int. Cl.[6] ..... A63H 27/08

[52] U.S. Cl. ..... 244/155 A

[58] Field of Search ..... 244/155 A, 153 R

[56] References Cited

U.S. PATENT DOCUMENTS

| | | | |
|---|---|---|---|
| 2,556,877 | 6/1951 | Howard | 244/155 R |
| 2,696,960 | 12/1954 | Howard | 244/155 A |
| 3,735,949 | 5/1973 | Theis, Jr. | 244/155 A |
| 3,770,230 | 11/1973 | Johnston | 244/155 A |
| 4,280,675 | 7/1981 | Davis et al. | 244/155 A |
| 5,533,694 | 7/1996 | Carpenter | 244/153 R |

*Primary Examiner*—Charles T. Jordan
*Assistant Examiner*—Patricia L. Zuniga

[57] ABSTRACT

A remote-control maintains the angle-of-attack of a tethered aircraft in fluxuating wind velocity. The tether is attached to the towing-point that is on a motor-driven tether-transporter. The transporter is secured to the structure of the aircraft. The angle-of-attack is modulated when actuating signals from a remote station cause the motor to propel the transporter, which carries the towing-point, to or fro, across the windward face of the aircraft.

8 Claims, 7 Drawing Sheets

FIG. 6
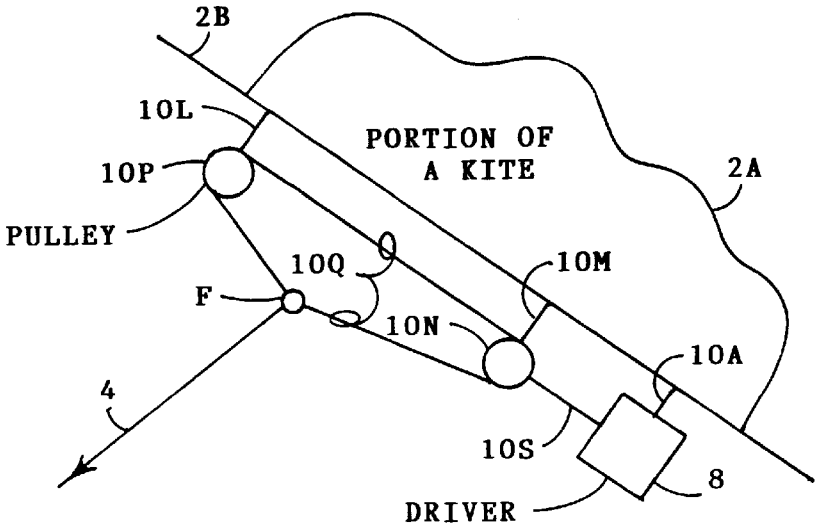
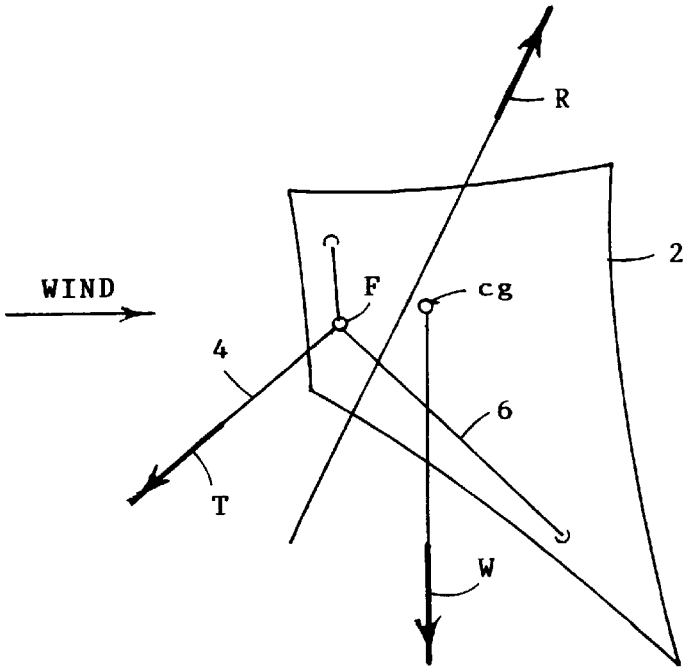
FIG. 7
--PRIOR ART--

TETHERED AIRCRAFT HAVING REMOTELY CONTROLLED ANGLE OF ATTACK

BACKGROUND

1. Field of the Invention

This invention relates to a tethered aircraft, specifically to a tethered aircraft having a remotely-controlled angle-of-attack.

2. Description of the Prior Art

A kite pulls hard when it flys low. When it flys low its angle-of-attack is large. When it flys high its pull is much less and its angle-of-attack is small. To make it fly high the string is fastened higher up on the kite. To make it fly low the string is fastened lower down on the kite.

The point to which the string is fastened is the towing-point. The towing-point is usually chosen by trial to produce flight at maximum altitude, but for greatest pull the towing-point is set to provide flight at lower altitudes.

When the string, the tether, is constant in length kites fly stock-still in midair in steady wind, and so, historically, kites were useful for lifting objects; photographic cameras, weather instrumentation, and before powered flight the lifting of people. Kites were used to tow wagons and boats. To tow these heavy objects low altitude flight provided the greatest pull. There were lifting and pulling applications with the string paying out or pulling in; strings of varying length.

It is believed that the aim with existing aerodynamic control devices, however seldom applied, was not to control the angle-of-attack, in particular, of tethered aircraft, but rather for lifting amusements.

But the drawback was that there were no means to adjust the flight characteristics of the kites to accomodate gusting and changing winds. Many, it is thought most, of the schemes were tested long before the development of flight controls. Without control apparatus flight becomes erratic in gusting and changing winds. Flight becomes translational and rotational and sometimes crashing. Lives were lost in man lifting operations. The tractors were erratic and there were crashes, sometimes fatal.

Deflecting surfaces as used on airplanes are employed on towed gliders, and they are applied to other tethered aircraft, but they are seldom used on kites. Vanes and vents, and tails and drouges, are devices that stabilize kite flight. Kites flown with multiple tethers display dives and loops.

But, for the most part, after the development of airplanes and the myriad technological advances of this century, profitable applications of kites have declined. So that the application of feedback controls and the like to kites, tethered aircraft, has languished.

On-board apparatus for precision movement of the towing-point from one location to another location on the body is not known to be in use. Weight limitations would reduce the effectiveness of old style controls that require on-board energy sources. Because apparatus to move the towing-point during flight is currently lacking, precision control of the angle-of-attack of tethered aircraft is not accomplished.

SUMMARY

The aim of this patent is to control the angle-of-attack. The provided apparatus enables the tethered aircraft to be flown at a particular, remotely-selected angle-of-attack in gusting and changing winds. In steady wind, with the apparatus, the aircraft can be flown from one angle-of-attack to another.

Consequently, this invention relates to tethered aircraft, more specifically to tethered aircraft having remotely-selected, remotely-controlled angles-of-attack at which angles-of-attack the aircraft flys in stall in force equilibrium.

The tethered aircraft having a remotely-controlled angle-of-attack of this invention includes an on-board towing-point driver that is actuated from a remote station to travel the towing-point from an initial location to a final location. Towing-point locations are indexed from the structure of the tethered aircraft via the center-of-gravity and the line-of-action of the wind-force resultant on the aircraft.

The operator of the invention, the kiter, selects an angle-of-attack which is input to the remote station. The output signal from the station correspondingly actuates the on-board towing-point driver to travel the towing-point to a different location.

The nature of a tethered-aircraft, a kite, is that for each of some, but not all, locations of its towing-point it flys in force equilibrium at a unique angle-of-attack. In steady wind, a wind whose velocity and direction are unchanging during a period of time, a kite flys in force equilibrium when it is neither rising or descending, nor traveling to the left or to the right, nor twisting about, this, according to C. F. Marvin, cited my patent U.S. Pat. No. 5,533,694.

This invention applies to and includes those final locations of the towing-point where flight is in stall in force equilibrium at a unique angle-of-attack.

I originate a definition of the term "angle-of-attack" for tethered aircraft flying in stall in force equilibrium. When the angle-of-attack is greater than about 25° the tethered aircraft is in stalled flight. The "angle-of-attack" of this invention is not defined for angles less than 25°. The defined angle of attack for airplane wings, airfoils, is usually less than 25°.

I have discovered and determined, for a tethered aircraft to fly in force equilibrium, that it is essential that the location of the towing-point is farther from the center-of-gravity than the perpendicular distance from the center-of-gravity to the line-of-action of the wind-force resultant of the aircraft. This discovery is demonstrated in the Figures and text of the following description of this invention.

Within the scope of the claims of this invention the upper limit of towing-point travel corresponds to angles-of-attack greater than about 25° for which angles flight is in stall, and the lower limit of towing-point travel corresponds to angles-of-attack where flight is in force equilibrium according to my discovery as described in the previous paragraph.

The travel of the towing-point causes the aircraft to fly from an initial site aloft in the sky to another site aloft where the flight is in force equilibrium at a unique angle-of-attack. When the towing-point is travelled from its initial location faster than the aircraft flies from its initial site in the sky, the towing-point will arrive at its final location before the aircraft arrives, later in time, at its final site in the sky.

Even though the effect of the remote-control of this invention is that, at the final site, the flight will be in force equilibrium, initially, at the initial site aloft, the flight might not be in force equilibrium; and then the motion of the aircraft will be translation and rotation at the initial site. But, however, the flight might be initially in equilibrium.

Refer to U.S. Pat. No. 5,533,694 (1996) to me, Howard G. Carpenter, for definition of the wind-force resultant and a method for locating its line-of-action relative to the structure of a tethered aircraft. The basis of this description is as described in U.S. Pat. No. 5,533,694. This invention applies equally to all kites, such as flats, bowed diamonds, boxes, compound cellulars, parafoils, and deltas. Tethered aircraft supported by wind are kites. Tethered propeller or jet powered fixed or rotary wing airplanes, towed gliders, and towed balloons are kites.

OBJECTS AND ADVANTAGES

The object of the present invention is to provide a tethered aircraft having a remotely-selected, remotely-controlled angle-of-attack at which angle-of-attack the aircraft flys in stall in force equilibrium.

Advantages of an aircraft having a remotely-controlled angle-of-attack include that:

1a. The aircraft is controllable to fly at a constant angle-of attack in gusting and changing winds.

2a. The aircraft is controllable to fly at a constant tether-inclination in gusting and changing winds, since tether-inclination is a function of the angle-of-attack.

3a. The aircraft is controllable to change, during flight, an initial angle-of-attack to another angle-of-attack.

4a. The aircraft is controllable to avoid disastrous crashes of former times, because the angle-of-attack can be corrected to maintain force equilibrium flight at the onset of wind changes. Consequently, since the aircraft is controllable, it is advantageously feasible to construct and fly very large kites, tethered aircraft.

5a. The aircraft is controllable to fly at less than maximum altitude, consequently it is advantageously feasible to employ kites, tethered aircraft, as tractors for pulling on heavy objects.

Because the system of this invention for remotely-controlling the angle-of-attack includes a towing-point transporter that is propelled by a towing-point driver, upon actuation of the driver from a remote-control station the towing-point is moved from location to location while the aircraft remains aloft, consequently further advantages are that:

1b. It is an advantage that the need to land the aircraft in order to remove the tether from one towing-point location and to attach it to another location is eliminated.

2b. It is an advantage that time aloft is saved by the elimination of landings.

3b. It is an advantage that the cost of labor for landings is saved by the elimination of landings.

4b. The aircraft is controllable to fly from a site aloft where it flew in force equilibrium to another site aloft where it flys in equilibrium after having had its towing-point travelled, slowly enough to maintain equilibrium during the travel, from an initial location to another location; the advantage is that rotation about the central axis was, is, and during towing-point travel remained, nearly zero.

Still further objects and advantages will become apparent from a consideration of the ensuing description and drawings.

BRIEF DESCRIPTION OF THE DRAWINGS

FIG. 6 is a side view of portion 2A of a tethered aircraft having moveable-flexible-belt bridle 10Q, towing-point F transporter. Belt 10Q, on structurally supported pulleys, carries towing-point F as it is propelled to or fro against opposing forces by towing-point driver 8 through shaft 10S.

FIG. 7 is a picture of a kite aloft in the wind and the forces on it. It is a copy of FIG. 1 in U.S. Pat. No. 5,533,694 (1996) to me, Howard G. Carpenter.

References in Drawings

Figure 1:
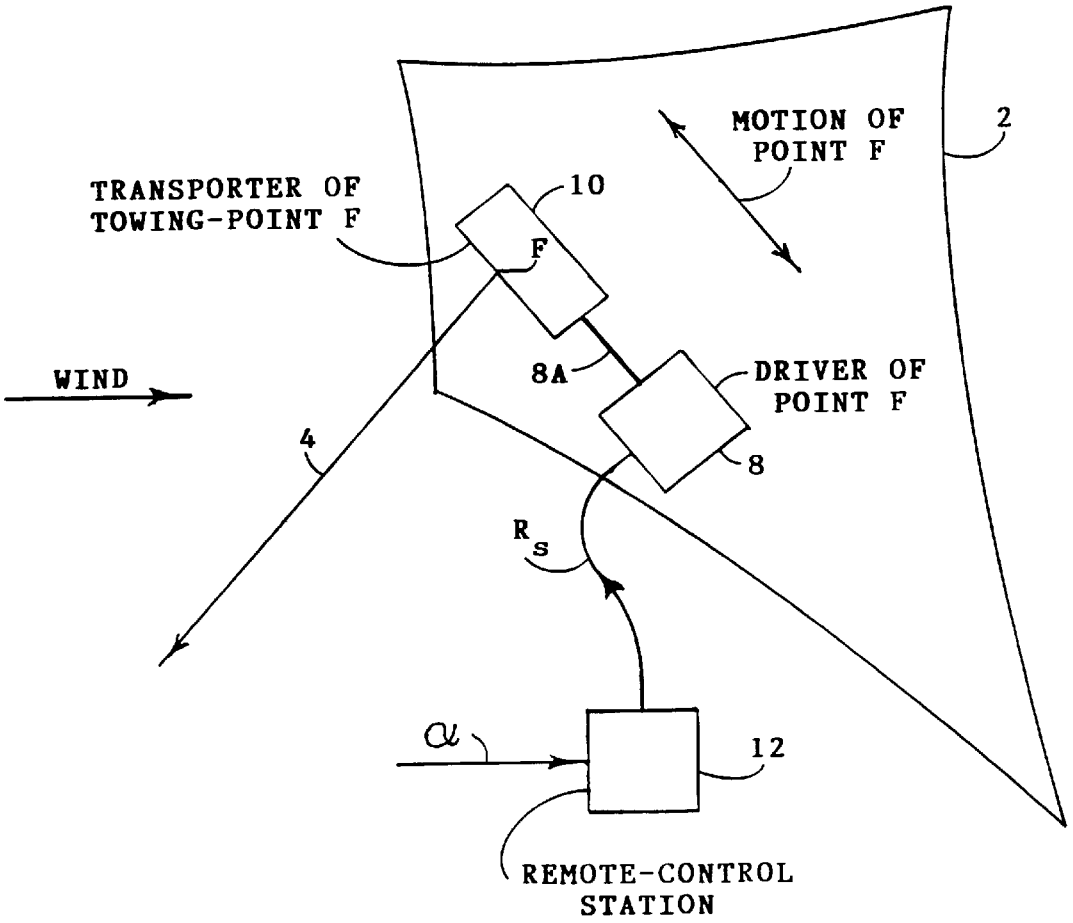
FIG. 1 is a schematic picture of the overall embodiment of this invention. It is a tethered aircraft having remotely-controlled angle-of-attack. It includes the typical aircraft, kite 2, aloft in the wind, and the remote control station 12 on-the-ground. Towing-point driver 8 propels towing-point F to or fro from location to location against opposing forces.

2 kite
2A portion of kite
2B spine of kite
4 tether
6 bridle
F towing-point
8 towing-point F driver
10 towing-point F transporter
12 remote-control station
14 sensor, angle-of-attack
16 comparator, difference between selected and actual in-flight angle-of-attack

18 controller, angle-of-attack $R_S$ signal, actuation, FIG. 1

Figure 2:
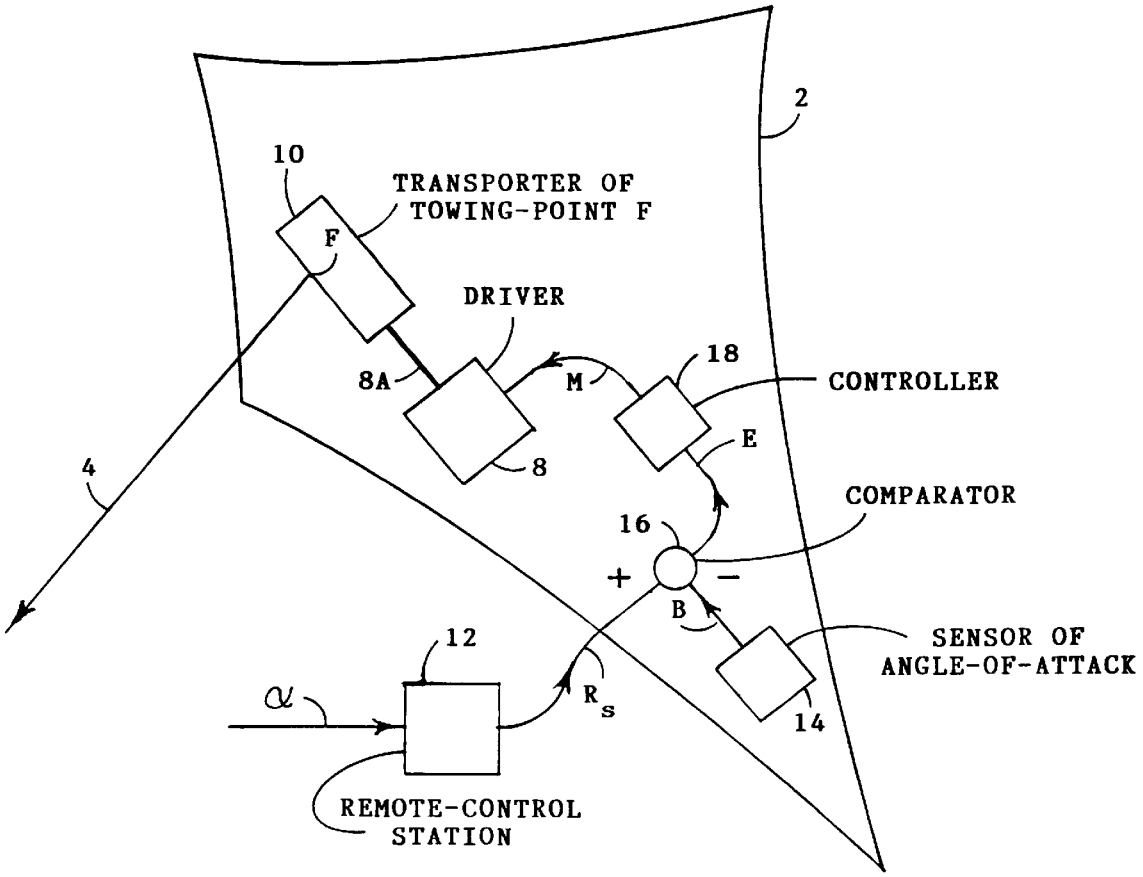
FIG. 2 is a similar to the schematic picture in FIG. 1 with additional on-board components for automatic feedback control of the angle-of-attack included.
Figure 3:
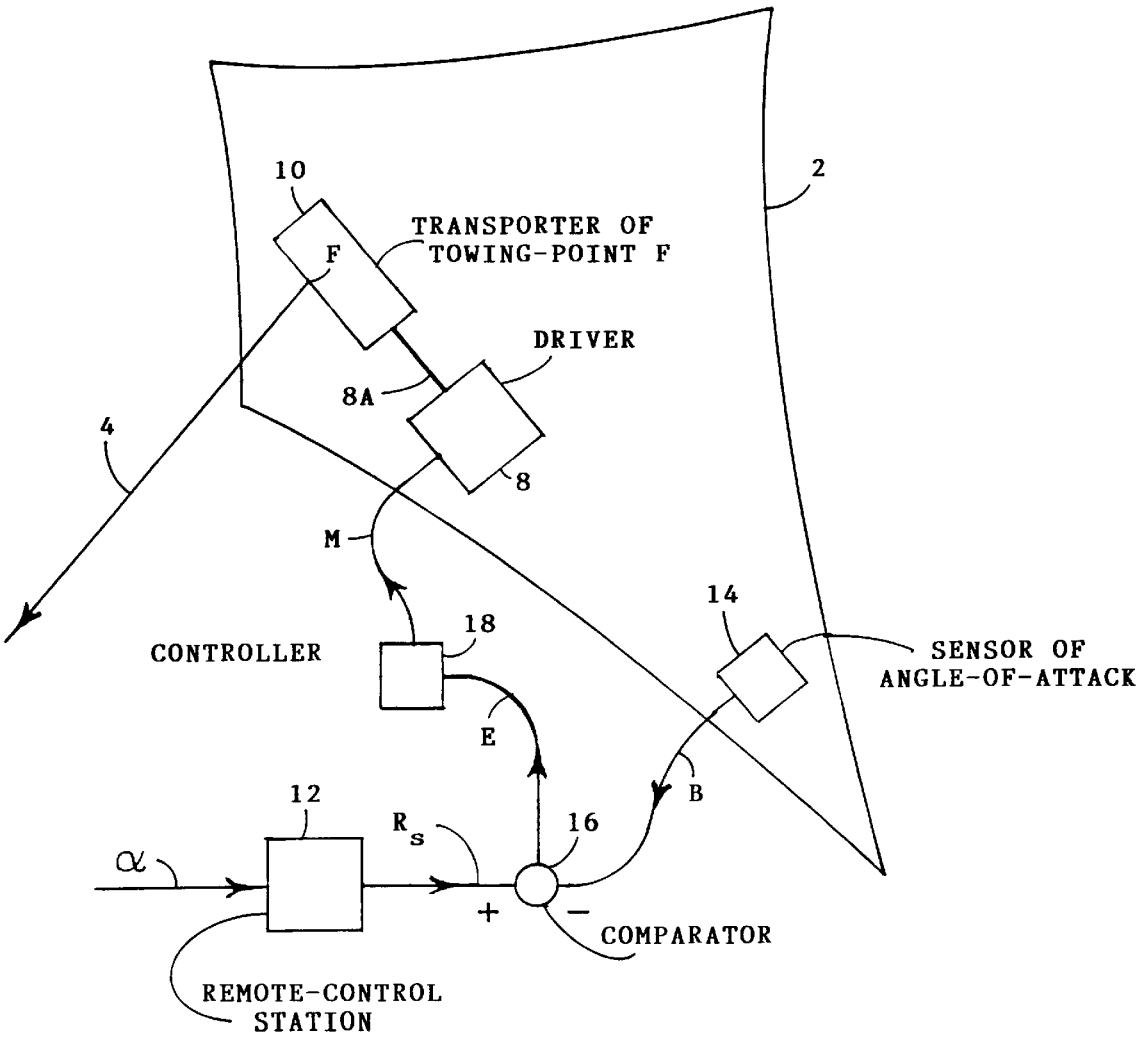
FIG. 3 is a similar to the schematic picture in FIG. 1 but with the additional included components for automatic feedback control of the angle-of-attack on-the-ground; except that angle-of-attack sensor-transmitter 14 is on-board the aircraft, the same as shown in FIG. 2.

$R_S$ signal, reference, FIGS. 2 & 3

B signal, sensor 14 output, feedback signal, FIGS. 2 & 3

E signal, error, output of comparator 16, FIGS. 2 & 3

M signal, controller output, function of error E, actuation signal to driver 8, FIGS. 2 & 3 cg center-of-gravity

10A support, supports driver 8 from structure of kite

Figure 4:
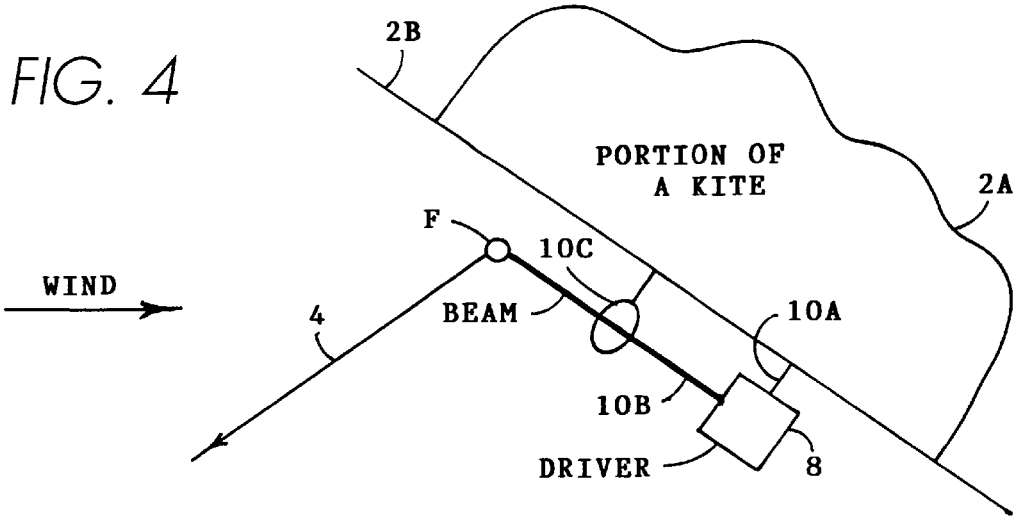
FIG. 4 is a side view of portion 2A of a tethered aircraft having rigid beam 10B, towing-point F transporter, that is supported from the structure of the aircraft. Towing-point driver 8 propels beam 10B which carries towing-point F to or fro against opposing forces.

10B rigid beam, towing-point F transporter, FIG. 4

10C plurality of guides, one shown, that support beam 10B, FIG. 4

Figure 5:
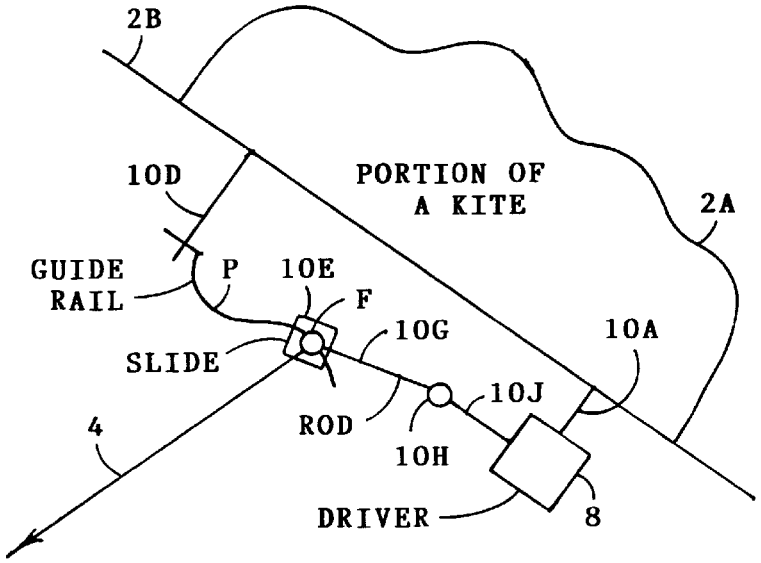
FIG. 5 is a side view of portion 2A of a tethered aircraft having guided slide 10E, towing-point F transporter, that is captured by structurally supported guide rail P. Slide 10E carries towing-point F as it is propelled to or fro against opposing forces along guide rail P by towing-point driver 8 through connecting rod 10G.
Figure 5A:
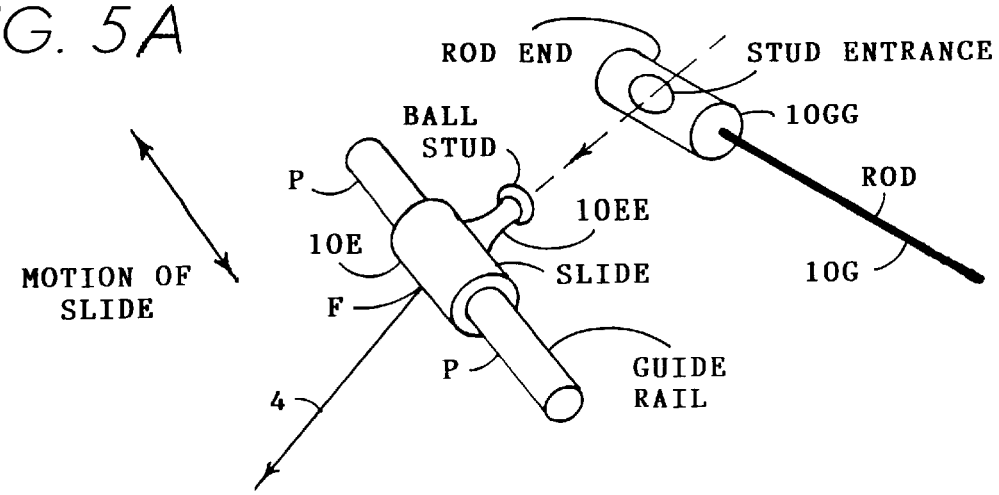

P guide rail for slide 10E, FIG. 5

10D support, supports guide rail P from structure of kite, FIG. 5

10E slide, transporter of towing-point F, FIG. 5

10J push rod, output of driver 8, FIG. 5

10G connecting rod, interconnects rod 10J and slide 10E, FIG. 5

10H hinge, flex joint between rods 10J and 10G, FIG. 5

10L support, supports pulley 10P from structure of kite, FIG. 6

10M support, supports pulley 10N from structure of kite, FIG. 6

10P idler pulleys, plurality, one shown, FIG. 6

10N drive pulley, FIG. 6

10Q flexible belt, bridle, FIG. 6

10S drive shaft, rotary, drives pulley 10N, FIG. 6

C Concurrent point of equilibrium forces

R force vector, wind-force resultant

T force vector, tether tension

W force vector, weight

Figure 8:
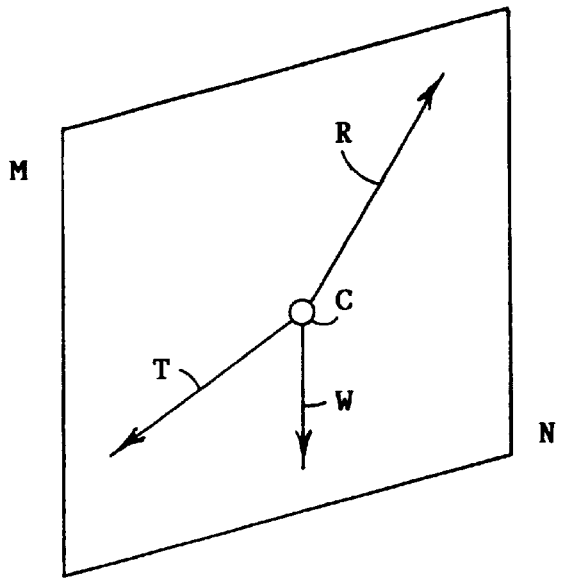
FIG. 8 is a picture of vertical coplane MN. Wind-force resultant R, tether-tension T, and plumb-line W lie within it and are concurrent at point C.

MN coplane of concurrent forces R, T, and W, FIG. 8

Figure 10:
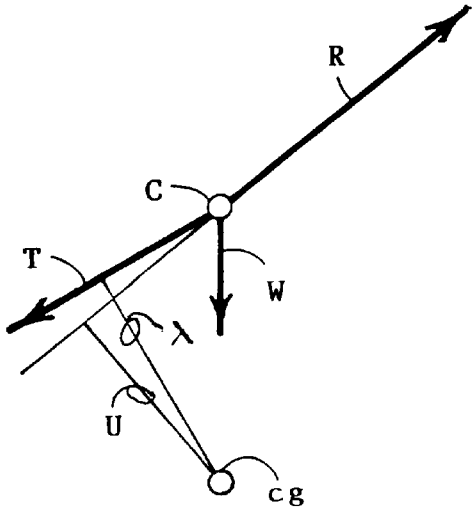
FIG. 10 is a diagram showing the distance $\lambda$ from the center-of-gravity cg to the line-of-action tension T exceeds the distance U from the center-of-gravity to the line-of-action of the wind-force resultant R.
Figure 11:
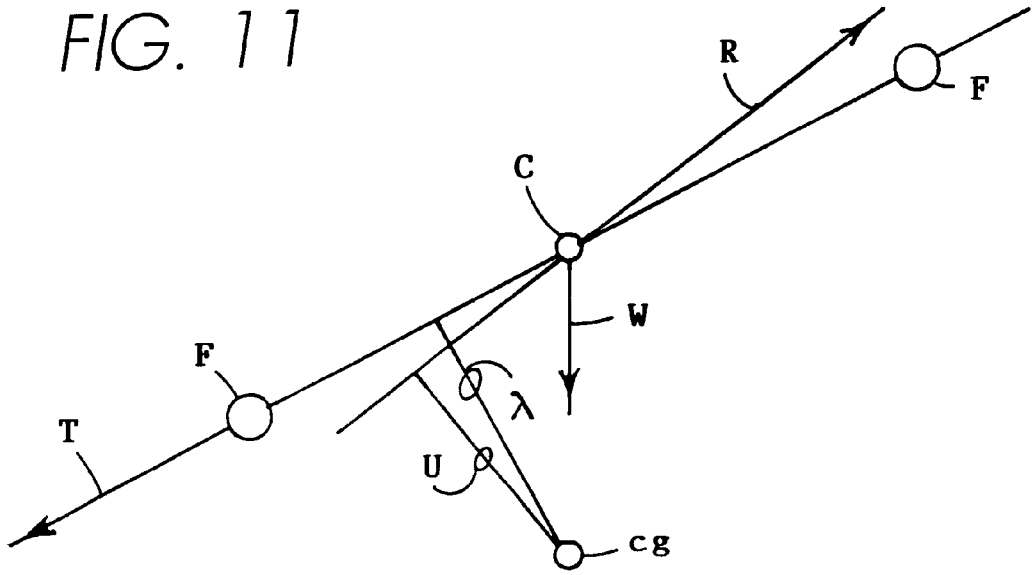
FIG. 11 is a similar diagram to that of FIG. 10 showing the location of two of an infinitude of towing-points F that lie on the line-of-action of tether tension T.

U distance, perpendicular from center-of-gravity cg to line-of-action of wind-force resultant R, FIGS. 10 & 11

Figure 12:
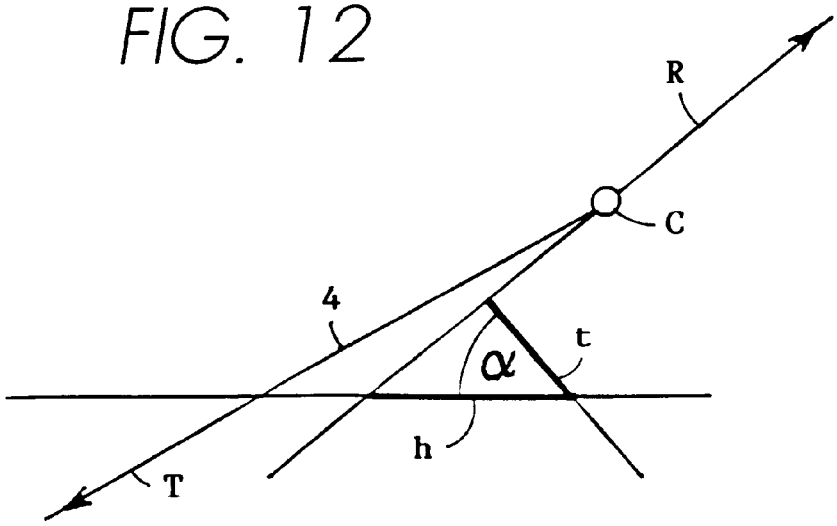
FIG. 12 shows that for a tethered aircraft flying in stall in force equilibrium the initial side of the angle-of-attack is the horizontal h and the terminal side is the perpendicular t to the line-of-action of wind-force resultant R. Horizontal h intersects the lines-of-action of tension T and wind-force resultant R.
Figure 1:
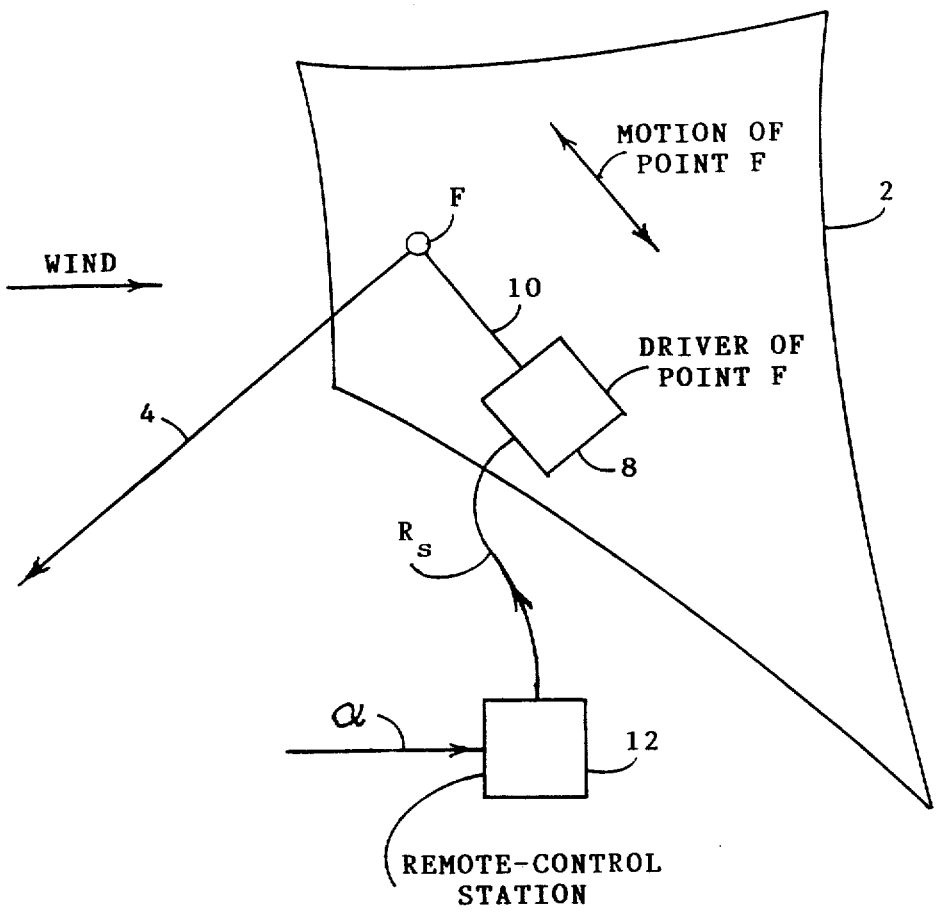
Figure 2:
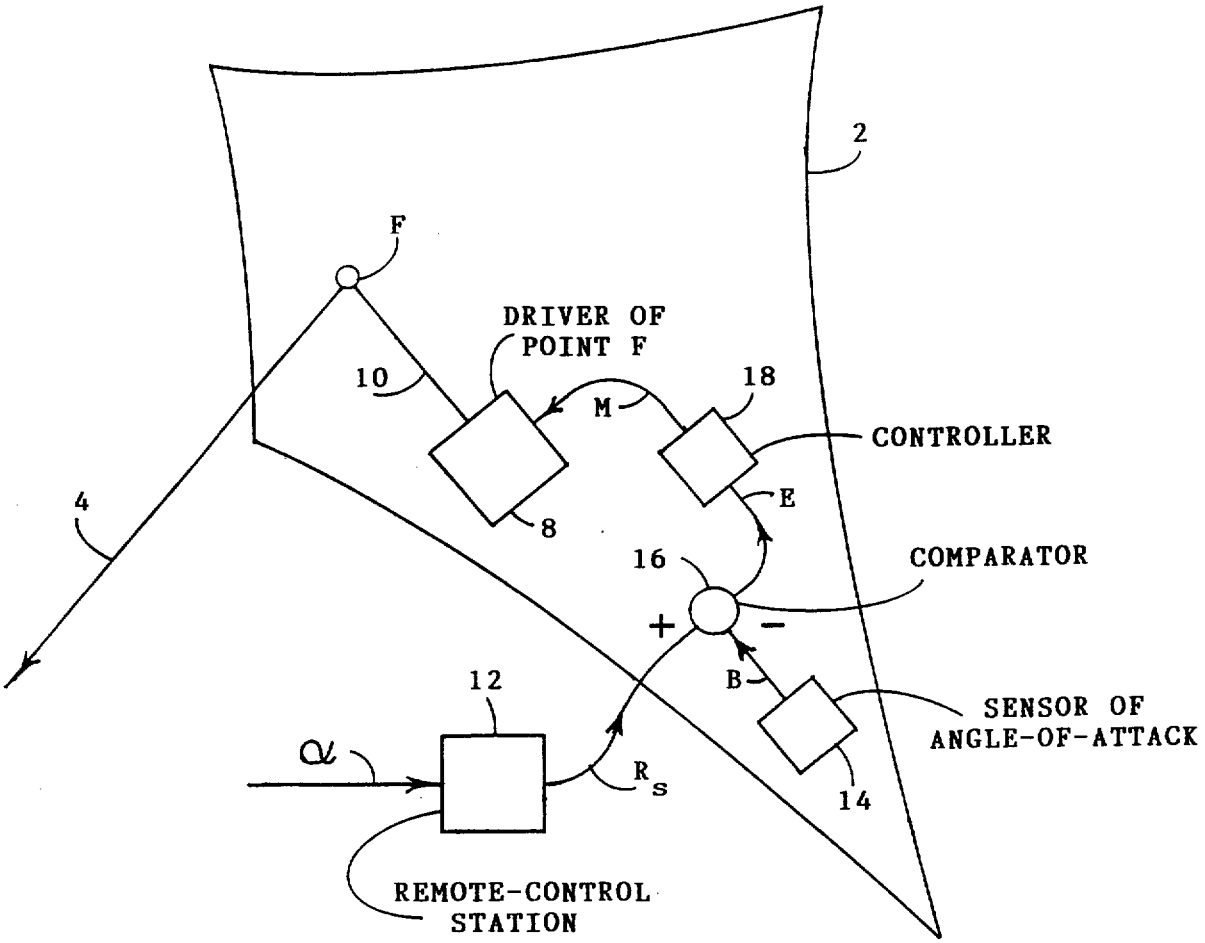
Figure 3:
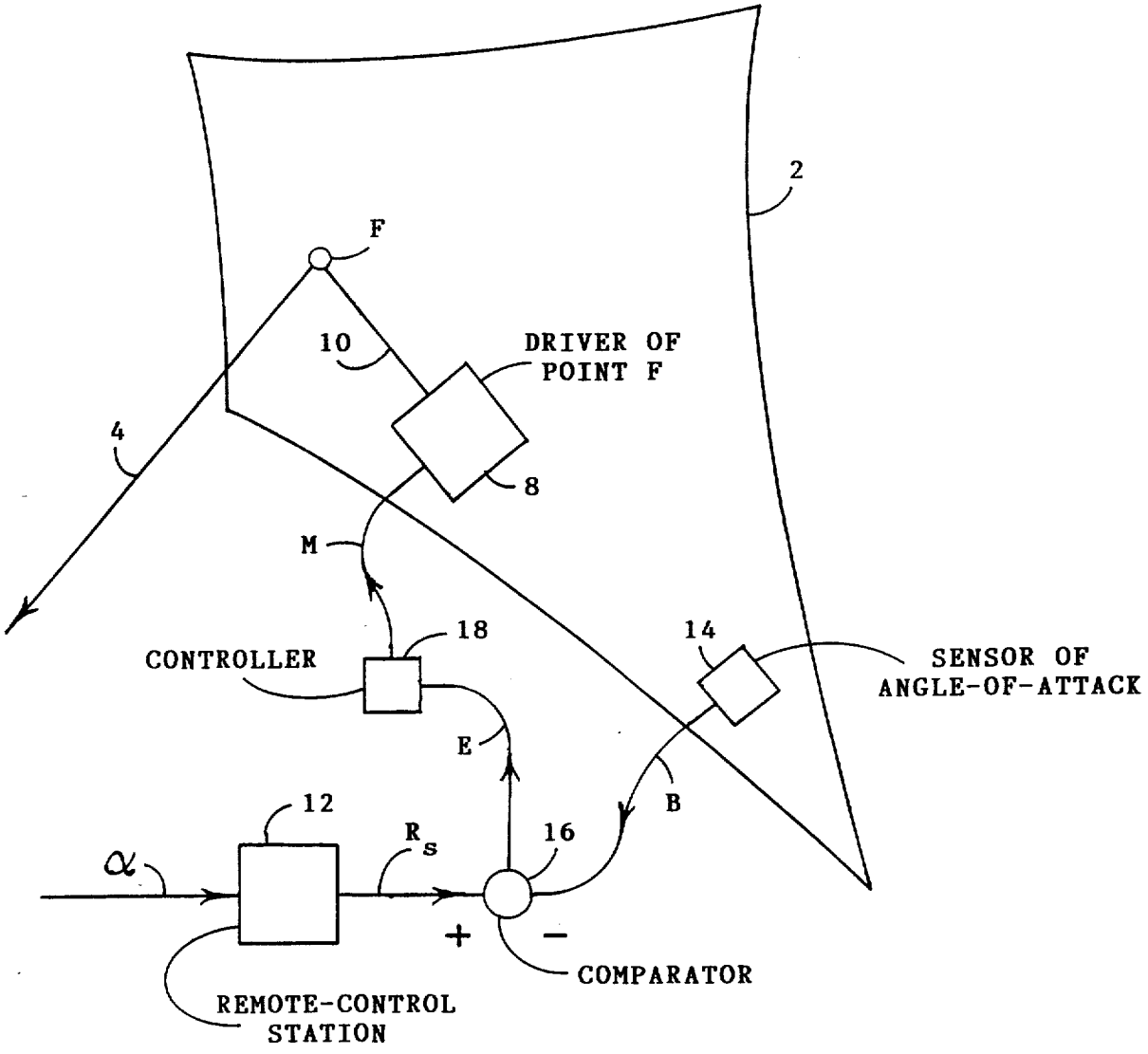
Figure 4:
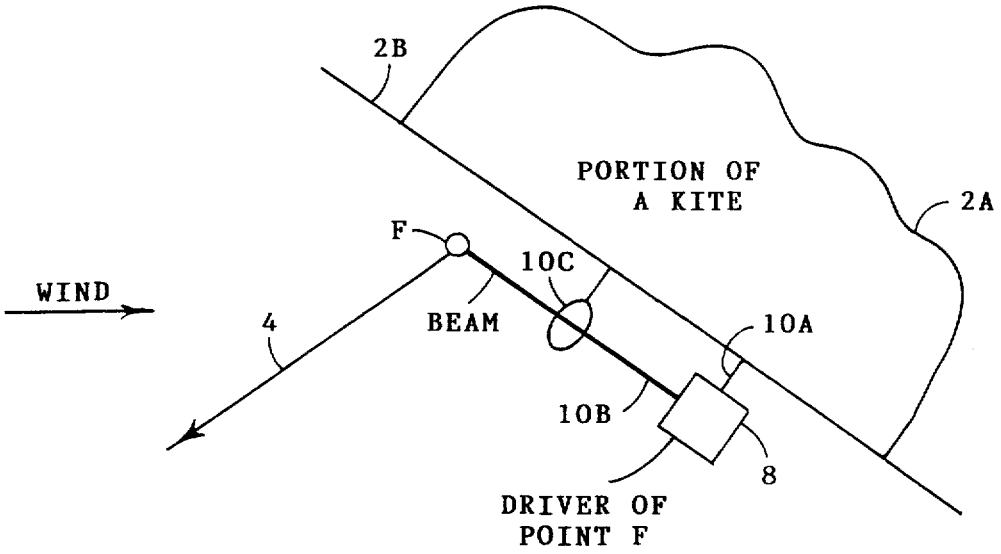
Figure 5:
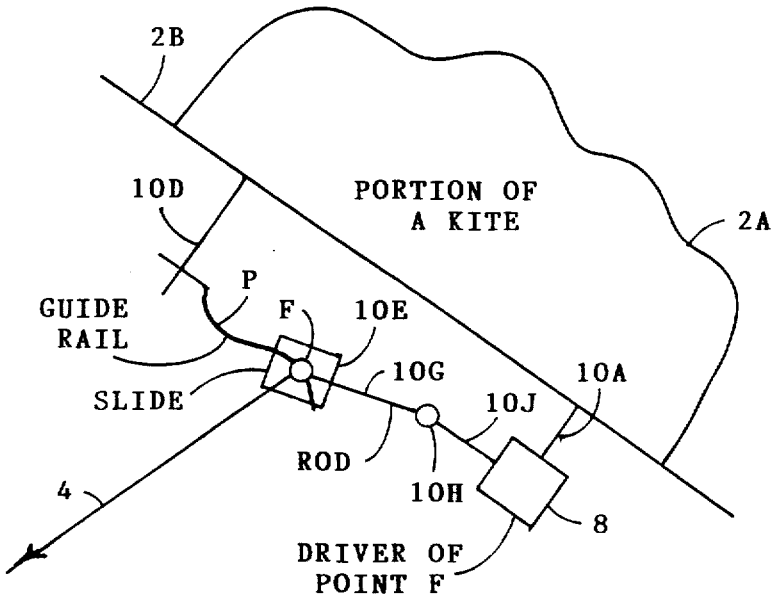
Figure 8:
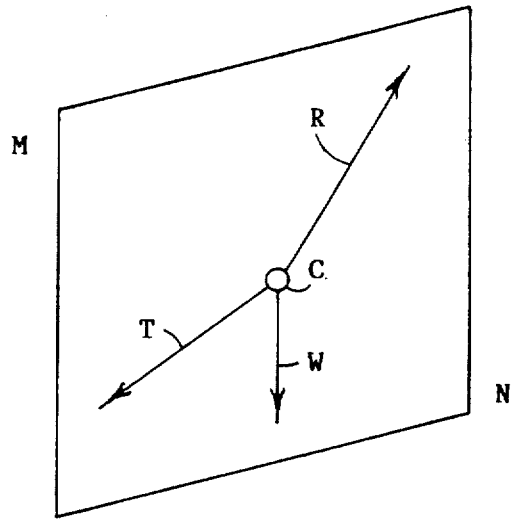
Figure 9:
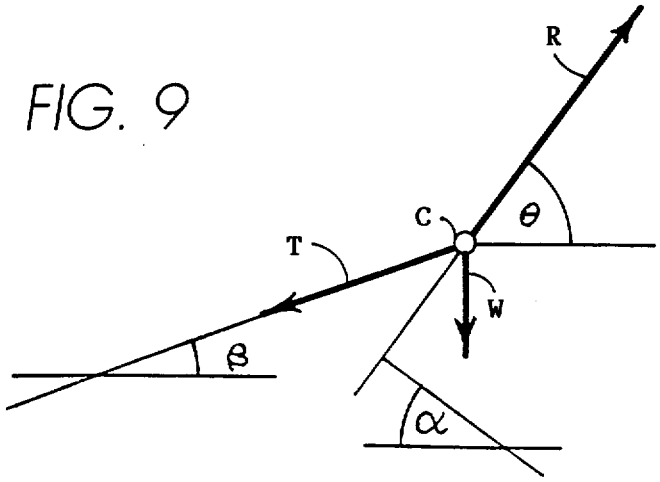
Figure 10:
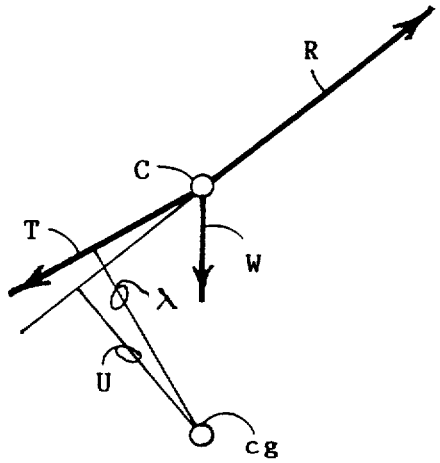
Figure 11:
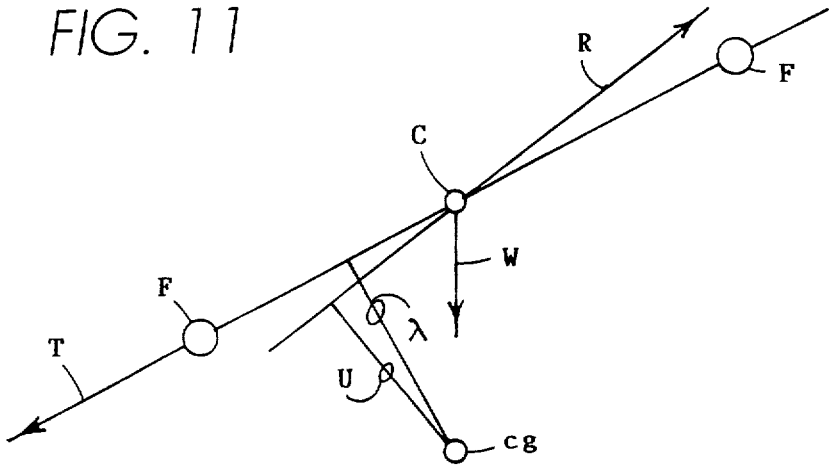
Figure 12:
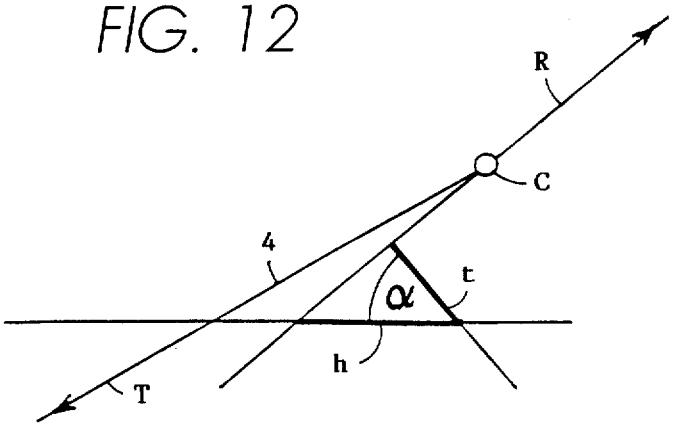

$\lambda$ distance, perpendicular from line-of-action of tether-tension T to center-of-gravity cg, FIGS. 10 & 11, "lambda"

h horizon, line, initial side of angle-of-attack $\alpha$, FIG. 12 t line, terminal side of angle-of-attack $\alpha$, FIG. 12

$\alpha$ angle, angle-of-attack, "alpha"

$\beta$ angle, tether-inclination, "beta"

$\theta$ angle, slope of wind-force resultant R, "theta"

DETAILED DESCRIPTION OF THE DRAWINGS

The overall embodiment of this invention is pictured in FIG. 1. It is a tethered aircraft having remotely-controlled angle-of-attack. It includes the typical aircraft, kite 2, aloft in the wind, and the remote-control station 12 on-the-ground. Square 12, FIGS. 1, 2, and 3, represents station 12.

In FIG. 1 the angle-of-attack control is shown to be manual feedback control. Contrastingly, in FIGS. 2 and 3 the angle-of-attack control is shown to be automatic feedback control.

The arrows to on-the-ground station 12, FIGS. 1, 2, and 3, labeled $\alpha$, represent operational inputs of selected angles-of-attack, set-points, to remote-control station 12. "Operational" inputs include "manual" or "automatic" inputs. The output of station 12 is signal $R_S$. FIG. 1 shows that signal $R_S$ is input directly to towing-point driver 8 for manual control. Square 8, FIGS. 1, 2, 3, 4, 5, and 6 represents towing-point F driver 8. In FIGS. 2 and 3, because the systems shown are automatic feedback control rather than manual, the output of station 12, reference signal $R_S$, is input to signal comparator 16, the summation point, instead of being input directly to driver 8. Circle 16, FIGS. 2 and 3, represent signal comparator 16.

Remote-control station 12 is shown to be on-the-ground in the FIGS. 1, 2, and 3, but station 12 can be located, as well, on another aircraft aloft, or remotely on the same aircraft, kite 2.

Towing-point driver 8 and moveable transporter 10 are interconnected and are on board the aircraft. Line 10, FIGS. 1, 2, and 3, represents transporter 10. Driver 8 and transporter 10 are supported by the structure of the aircraft, kite 2, FIGS. 1, 2, and 3. It is shown in FIGS. 4, 5, and 6 that driver 8 is supported from the structure of the aircraft by support 10A. Towing-point driver 8 includes the motor for propelling transporter 10, the power source for energizing driver 8, and actuator apparatus for controlling towing-point driver 8, all not separately shown in figures. Design power for the motor can as well be electric, or hydraulic, or compressed gas, etc. The actuator responds to input signal Rs, FIG. 1, or to input signal M, FIGS. 2 and 3, to cause driver 8 to correspondingly propel transporter 10. Transporter 10 is guidedly secured to the structure of the aircraft. The actuator, included in driver 8, responds to input signal Rs, FIG. 1, or to input signal M, FIGS. 2 and 3.

Towing-point F is a point on transporter 10. Circle F, FIGS. 1, 2, 3, 4, 5, 6, and 11, represents towing-point F. The top end of tether 4 is fastened to transporter 10 at towing-point F. The two-headed arrow, FIG. 1, shows that the motion of towing-point F is to or fro relative to the structure of the aircraft, typically kite 2.

FIGS. 2 and 3 each show that the overall embodiment is augmented by the addition of an automatic control system. In both FIGS. 2 and 3 it is shown that angle-of-attack $\alpha$ sensor 14 is mounted on-board the aircraft. Square 14, FIGS. 2 and 3, represents angle-of-attack $\alpha$ sensor 14. In FIG. 2 included components of the automatic system are on-board the aircraft, whereas automatic system components included in FIG. 3 are shown to be on-the-ground.

On-board components shown in FIG. 2 include signal comparator 16 and controller 18 as well as angle-of-attack $\alpha$ sensor 14. Square 18, FIGS. 2 and 3, represents controller 18. In FIG. 3 comparator 16 and controller 18 are shown to be on-the-ground; angle-of-attack $\alpha$ sensor 14 is on-board as it is in FIG. 2. In FIGS. 2 and 3, the output of remote-control station 12 is reference signal $R_S$. Signal $R_S$ is input to comparator 16. The output of angle-of-attack $\alpha$ sensor 14 is signal B. Signal B is input to comparator 16. Signal B is the automatic feedback signal. The output of comparator 16 is signal E. Signal E is the difference between signals $R_S$ and B. Signal E is input to controller 18. The output of controller 18 is signal M. Signal M is input to towing-point driver 8. Signal M is the actuator signal that is input to the actuator of towing-point driver 8 that controls driver 8.

In FIGS. 2 and 3 angle sensor 14 includes any of a variety of perfected devices for measuring and sending angle-of-attack signals to comparator 16.

FIG. 4 shows one version of transporter 10 that is shown in FIG. 1. A plurality of guides 10C (one guide shown) retain and support rigid beam 10B from the structure of the aircraft. Portion 2A of the aircraft, kite 2, is shown in FIG. 4. Rigid beam 10B is slideable through guides 10C, to or fro, relative to spine 2B of the aircraft, kite 2. Spine 2B is the axis of symmetry of the support surfaces of the aircraft.

Towing-point F is on beam 10B. Tether 4 is fastened to beam 10B at towing-point F. The output of towing-point driver 8 is connected to beam 10B. Towing-point driver 8 propels beam 10B which carries towing-point F back or forth from location to location against opposing forces. The motion of towing-point F is relative to spine 2B.

FIG. 5 shows a second version of transporter 10 that is shown in FIG. 1. Guide rail P is rigidly supported by support-member 10D from the structure of the aircraft. Slide 10E is captured by rail P. Slide 10E is freely moveable along rail P. Towing-point F is on slide 10E. Tether 4 is attached to slide 10E at towing-point F. Guide-rail P is curved. Towing-point driver 8 propels push rod 10J in linear translation, FIG. 5. Connecting rod 10G interconnects slide 10E and push rod 10J. Hinge 10H, between rods 10J and 10G, and the hinging included in slide 10E provide flexible motion to rod 10G as towing-point F is driven from location to location on curve P. The motion of towing-point F in FIG. 5 is relative to spine 2B of the aircraft, kite 2. Towing-point driver 8 propels towing-point F to or fro against opposing forces. Portion 2A of kite 2 is shown in FIG. 5.

The third version, shown in FIG. 6, of transporter 10 that is shown in FIG. 1, includes a moveable-flexible-belt bridle which carries towing-point F to or fro. Flexible belt 10Q is deployed around pulleys 10P and 10N. Pulleys 10P and 10N are mounted on shafts (not shown) that are supported by support members 10L and 10M on the structure of the aircraft, kite 2, FIG. 6. Portion 2A of kite 2 is shown in FIG. 6. Towing-point F is on the windward part of belt 10Q. Tether 4 is fastened to belt 10Q at towing-point F. The windward part of 10Q is the bridle. The parts of belt 10Q are essentially coplanar with spine 2B of the aircraft, kite 2. Pulley 10N is a drive pulley. Pulley 10P is one or a plurality of idler pulleys. Output shaft 10S of towing-point driver 8 is connected to drive pulley 10N. Towing-point driver 8 rotates pulley 10N which imparts motion to belt 10Q. The motion of towing-point F, carried on belt 10Q, is relative to the spine 2B of the aircraft, kite 2. Towing-point driver 8 propels towing-point F to or fro from location to location against opposing forces.

A tethered aircraft, kite 2, is pictured in FIG. 7; it is a rigid body, at rest with respect to the ground, flying in stall in force equilibrium in steady wind, in which wind kite 2 is neither rising or descending, nor traveling to the left or to the right, nor twisting about.

This FIG. 7, in this invention, is a copy of FIG. 1 in U.S. Pat. No. 5,533,694 (1996) to me, H. G. Carpenter. The arrows are force vectors R, T, and W superposed on the picture of kite 2. Vector R is the resultant R of the wind forces on the aircraft, wind-force resultant R. Vector W is the weight of kite 2. Tether 4 is shown connected to bridle 6 at towing-point F. Vector T is the tension in tether 4.

Parts of my U.S. Pat. No. 5,533,694 are quoted in this description. Quoting, "The location of the line-of-action of the wind-resultant force is a property of the aircraft. For a tethered aircraft that flies in equilibrium; whatever the angle of attack, once the location of the line-of-action of resultant R is marked on the structure, resultant R remains fixed relative to the structure, however, within a range, the site of the towing-point or the weight distribution is altered."

Wind-force resultant R is the vector sum of the forces of only the wind on kite 2. In equilibrium flight the resultant of all of the forces, R, T, and W, on kite 2 is zero. In FIG. 7 the center-of-gravity cg of kite 2 is shown to lie on the vertically downward line-of-action of weight W, the plumb line. The line-of-action of tether-tension T is tangent to the center line of tether 4 at towing-point F.

Even though kite 2, pictured in FIG. 1 of U.S. Pat. No. 5,533.694, and in FIG. 7, this description, is an Eddy type bowed diamond kite, this invention applies equally to all kites.

The plane, pictured in FIG. 8, is coplane MN. In force equilibrium flight the forces, wind-force resultant R, weight W, and tension T, all on a tethered aircraft, are concurrent and within vertical coplane MN. Wind-force resultant R and weight W are independent forces. Tension T is their dependent force. The forces are concurrent at point C, FIGS. 8, 9, 10, 11, and 12. Coplane MN is vertical, because the plumb line W within it is vertical. The supporting surfaces of a tethered aircraft in equilibrium flight are essentially symmetrical about coplane MN.

Figure 9:
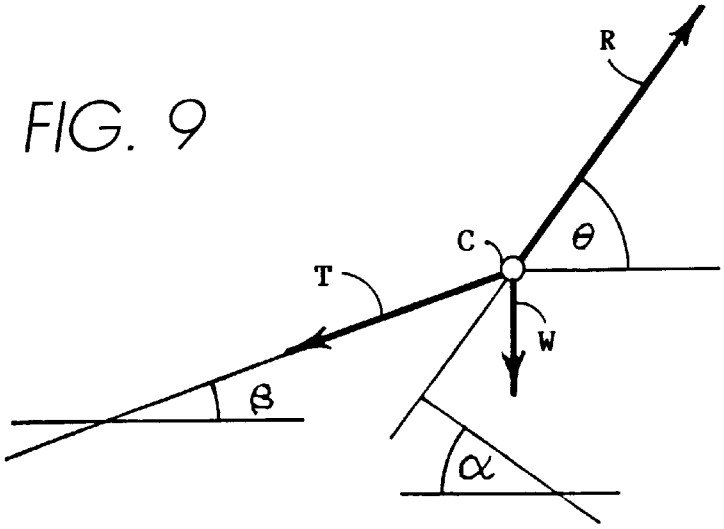
FIG. 9 is a diagram of the three coplanar forces, resultant R, tension T, and weight W in equilibrium, showing that the slope $\theta$ of resultant R exceeds the slope $\beta$ of tension T so as to lift weight W.

It is seen in FIG. 9 that wind-force resultant R, the independent force, lifts the weight W and, also, produces dependent tension T. In force-equilibrium flight, these forces are coplanar and concurrent at point C, FIGS. 8, 9, 10, 11, and 12. In equilibrium flight, the slope $\theta$. of wind-resultant force R exceeds the slope $\beta$ of tension T. Angle $\alpha$ is the complement of angle $\theta$. Angle $\alpha$ is the angle-of-attack, FIGS. 9 and 12. Were the slope of R the same as the slope of T then forces R and T would be opposite in direction, collinear, and equal in magnitude, and no weight could be lifted, for all of the independent force R would be used up to balance dependent tension T. It then follows, that no flight can be accomplished, especially force equilibrium flight, no weight can be lifted, unless the slope of vector R exceeds the slope of vector T. In equilibrium flight the magnitude of R always exceeds the magnitude of T by enough to lift the weight W. In force equilibrium flight the magnitude of wind-force resultant R exceeds the magnitude of tension T.

I have discovered and determined a property of a tethered aircraft that is necessary for the tethered aircraft to fly in force equilibrium. The property is that it is necessary that the distance $\lambda$ from the center-of-gravity cg to the line-of-action of tension T must exceed, be longer than, the distance U from the center-of-gravity cg to the line-of-action of wind-force resultant R, FIG. 10. The terminal side t, FIG. 12, of angle $\alpha$ coincides with moment arm U, FIGS. 10 and 11.

Distance $\lambda$ and distance U are lever arms of the moments around center-of-gravity cg. When flight is in force equilibrium the sum of these moments is zero. In equilibrium flight, as stated above, FIG. 9, in order to lift weight W, the magnitude of wind-resultant force R exceeds tension T, consequently the moment arm $\lambda$ must exceed, has got to be longer, than the moment arm U for the moment sum to be zero.

The distance U is invarient, constant, it is a property of the aircraft. Quoting further from above cited U.S. Pat. No. 5,533,694, "resultant R remains fixed relative to the structure." So, also, resultant R remains fixed at distance U from the center-of-gravity, a determinable, fixed point within the structure.

Contrastingly, the distance $\lambda$ is variable. It varies as the angle-of-attack $\alpha$ is varied.

The top end of the tether is fastened to the tethered aircraft at towing-point F, so that in FIG. 11 towing-point F is shown to be on the line-of-action of tether tension T. Towing-point F may be at any location on the action line of tension T; for understanding, towing-point F is shown to be at only two locations on tension T, FIG. 11. FIG. 11 is a copy of FIG. 10 except that towing-point F has been added to FIG. 11.

Because both FIG. 10 and FIG. 11 represent flight in force equilibrium, as it is seen in FIG. 10, it is also seen in FIG. 11 that the length of arm $\lambda$ exceeds that of arm U.

Consequently, when flight is in force equilibrium, any location of towing-point F is farther from the center-of-gravity than the perpendicular distance U from the center-of-gravity to the line-of-action of the resultant of the wind forces on the tethered aircraft, the wind-force resultant R. This is a property of tethered aircraft that I have discovered and determined.

The Angle of Attack

A precise definition of the term "angle-of-attack" for a tethered aircraft in stalled, force equilibrium flight is originated. The definition is illustrated in FIG. 12. The definition is that, in force equilibrium flight the initial side of the angle-of-attack is the horizon, a horizontal line, and the terminal side is a perpendicular to the line-of-action of the wind-force resultant, U.S. Pat. No. 5,533,694.

A kiter who has rigged a kite has seen that, in the same wind, when the towing-point is too low the kite flies too low, but when the towing-point is higher up on the kite the kite flies higher and is more nearly level; the angle of attack is much smaller. It is observed, that, within limits, for each location of the towing-point there is a unique angle of attack.

This invention is a tethered aircraft having precision control of the flight at remotely selected angles-of-attack in varying winds. This invention is limited to angles-of-attack for which flight is in stall in force equilibrium. Consequently, an exact definition of the term "angle-of-attack" of a tethered aircraft, a kite, is created.

In current use, until this definition, FIG. 12, the widely used term "angle of attack", the attitude, of a tethered aircraft in flight, is descriptive but lacks precision. In general "angle of attack" of a tethered aircraft has described the angle between the horizon and the windward face of the aircraft. But when the face is curved or the aircraft has a multiplicity of faces, support surfaces, among which to choose, then the term "angle of attack" can only be descriptive. Without a precisely defined "angle-of-attack" the towing-point can not be reliably located so as to cause the aircraft to fly in stall, in force equilibrium at an exact, unique "angle-of-attack." Without a precisely defined "angle-of-attack" the location of the towing-point can not be reliably indexed for a precision angle-of-attack. It is noted that the angle of attack of an airfoil is one thing and the angle-of-attack of a kite is another.

It is shown in FIG. 12, that the force vectors T and R intersect at concurrent-point C, and so the diagram in FIG. 12 applys to a tethered aircraft in equilibrium flight. Vectors T and R are described above, as cited in U.S. Pat. No. 5,533,694. The definition of the angle-of-attack, $\alpha$, is that, in equilibrium flight, the initial side of angle $\alpha$, FIG. 12, is horizontal line h, and the terminal side of angle $\alpha$ is the perpendicular, line t, to the line-of-action of wind-force resultant R. Horizontal line h intersects the center line of tether 4, and, also, the line-of-action of wind-force resultant R. Perpendicular t intersects horizontal h.

Cited U.S. Pat. No. 5,533,694 is the basis of the above definition of angle-of-attack $\alpha$, because the terminal side t of angle $\alpha$ is perpendicular to the action line of resultant R, FIG. 12. It is explained in the above cited U.S. Pat. No. 5,533,694 that in stalled flight wind-force resultant R is a property of a tethered aircraft.

Operation of the Invention

This invention of a tethered aircraft having a remote control is operated to cause the aircraft to fly from a site aloft to another site aloft where the aircraft flys at a selected angle-of-attack $\alpha$ in stall in force equilibrium. Operation to maintain a selected angle-of-attack in fluxuating and gusting wind is included.

To operate the manual feedback control system pictured in FIG. 1 the human operator dials his selected angle-of-attack into remote control station 12. Station 12 generates and transmits correspondingly scaled angle-of-attack signal $R_S$ to actuate the on-board towing-point driver 8, FIG. 1. The response of the actuated driver 8 to signal $R_S$ is to propel towing-point transporter 10. Towing-point F, on transporter 10, is carried by transporter 10 from location to location relative to the structure of the aircraft. The human operator is called the kiter or the aircraft pilot.

Under manual feedback control, FIG. 1, the observer of the angle-of-attack, the human operator, senses and controls the difference between the in-flight angle-of-attack and his dialed in selected angle-of-attack. The human observation is the feedback signal. The human operator observes the value of the in-flight angle-of-attack, the output angle, and if it is different from his previously dialed in desired value, the input angle, he can control, correct, the output angle by dialing a corrected angle into control station 12. Paraphrasing, "A feedback control system is a control system which tends to maintain a prescribed relationship of one system variable to another by comparing functions of these variables and using the difference as a means of control" see text books on feedback control.

The human operator may be slow to respond to the effect of wind gusts that drive the aircraft away from equilibrium flight at the desired angle-of-attack. The human will err during his effort to maintain his angle-of-attack, for maintaining the angle-of-attack is a menial task. His reactions will often be too slow to respond to the effects of fluxuating and gusting wind.

These shortcomings are overcome by automation of the feedback, FIGS. 2 and 3. The automatic feedback function is accomplished by replacing the human operator's observation of the in-flight angle-of-attack and his controller duties with angle-of-attack sensor-transmitter 14, comparator 16, and controller 18.

With the automatic feedback control systems pictured in FIGS. 2 and 3 the only remaining duty of the human operator is to dial his selected angle-of-attack $\alpha$ into remote control station 12; the same as he does in the above described manual system, FIG. 1. The output from station 12, signal $R_S$, FIGS. 2 and 3, is compared to signal B by comparator 16. Signal B is the scaled output from sensor 14. Signal B represents the in-flight angle-of-attack $\alpha$. Output E of comparator 16, the error signal, is input to controller 18. The response of controller 18 is to produce correcting signal M which actuates driver 8. Driver 8 propels transporter 10 so as to travel towing-point F from location to location relative to the structure of the aircraft.

As towing-point F is travelled from one location to another the tethered aircraft flys from an initial site aloft to another site aloft where the aircraft flys in force equilibrium at a new and different angle-of-attack. When the towing-point is travelled faster from location to location than the flight of the aircraft from the initial site to the final site the aircraft will arrive later in time at the final site in the sky than the arrival of the towing-point at its final location.

Limits of Towing-Point Locations for Controlled Angles-of-Attack

Because this invention relates to a tethered aircraft having a remotely-controlled angle-of-attack, and, because, the angle-of-attack is defined, in this invention, only for flight of the aircraft in stall in force equilibrium, the towing-point travel of this invention is limited, restricted, to those locations of the towing-point for which the aircraft flys from an initial site aloft, to fly finally in stall in force equilibrium at a final site at a selected, desired, angle-of-attack.

A tethered aircraft having a tether of a given length flys high when the towing-point is located high up relative to the structure and it flys low when the towing-point is lower down on the aircraft. At high altitude the angle-of-attack is small. At low altitude the angle-of-attack is large. One limit of towing-point travel corresponds to high altitude flight at a small angle-of-attack. The second, other, limit of towing-point travel corresponds to low altitude flight at a large angle-of-attack.

Beyond the one, the upper, limit of towing-point travel, because the angle-of-attack becomes small, stalled flight is replaced by aerodynamic lifting type flight; for which the angle-of-attack of this invention is not defined. Beyond the second, the lower, limit of towing-point travel force equilibrium cannot be accomplished and flight becomes translational and rotational, and sometimes crashing.

Transporter 10, FIGS. 1, 2, and 3, is driven by driver 8 to carry towing-point F along a "path-of-travel" of towing-point F locations relative to the structure of the aircraft. One version of transporter 10 is shown in FIG. 4, another in FIG. 5, and yet another in FIG. 6. Associated with each of these versions is a different path-of-travel. In FIG. 4 the path-of-travel is a straight line, in FIG. 5 it is a general curve determined by the form of guide P, and in FIG. 6 the path is essentially elliptical. These are typical paths-of-travel; other versions of transporter 10 and their associated paths-of-travel are conceivable. The paths-of-travel are generally coplanar with spine 2B, FIGS. 4, 5, and 6, of the tethered aircraft.

Only the portion of any path-of-travel of the towing-point that corresponds to an angle-of-attack for flight in stall in force equilibrium is specific to this invention, eventhough the mechanical design of any or all of these versions of transporter 10 and the associated driver 8 can be such that the towing-point F can be travelled beyond the above required limits for flight in stall in force equilibrium. Alternatively, the mechanical design can include travel stops on the path-of-travel to prevent overrunning the limits, or another alternative is that the human operator may carefully avoid dialing-in angles-of-attack that cause responses that exceed the required limits. With these provisions, equilibrium flight in stall can be accomplished, and, consequently, the angle-of-attack is controlled, and so the range, the scope, of this invention is not exceeded.

About the Upper Limit of Towing-Point Locations

The definition, given in this description, of the angle-of-attack does not apply to an airfoil, an airplane wing, because the resultant of lift and drag on the airfoil is tilted rearward; the resultant of lift and drag is not perpendicular to a surface or line, chord line. Compare the airfoil to the resultant R of a kite, which R is normal to the ideal equivalent plate, described below.

Quoting from cited U.S. Pat. No. 5,533,694, "A kite is a tethered aircraft flying in a stalled state," David Pelham, The Penquin Book of Kites, 1976. In stalled flight aerodynamic circulation effects are nil.

"Assume that each surface of a kite is equivalent to an inclined flat plate and assume that the horizontal wind that strikes the inclined plate is a jet whose cross section is the same as the horizontal projection of the inclined plate. Wind energy loss due to impact, edge effects, and friction are taken to be small, and, hence, the momentum of the exiting wind is essentially unchanged from that of the striking wind. Then the force exerted on the plate is normal to it.

"A kite is an assembly of such surfaces supported by wind forces. The forces on the assembly of separate surfaces are reduced to a single wind-resultant R at a location that is unchanging relative to the body of the kite for every angle of attack."

In stalled flight it is, therefore, that wind-force resultant R is normal to an ideal flat plate that is equivalent to the assembly of surfaces, supported by wind forces, that constitute a tethered aircraft. Refer to the ideal flat plate as an equivalent supporting plane surface.

For any angle-of-attack greater than about 25°, the well known stalling angle of airfoils, a kite, a tethered aircraft flys in stall. This invention is concerned with the flight of tethered aircraft at angles-of-attack that are greater than the stalling angle.

In the case of an airplane wing, the general definition of the angle-of-attack is that the angle $\alpha$ is the inclination between the chord line and the direction of the relative wind velocity, Marks' Handbook. This definition applys to a wing up to a critical angle called the stalling angle. It does not apply to a tethered aircraft, a kite, flying in stall.

Paraphrasing Marks' Handbook; for an airfoil at a critical angle of attack, called the "stalling angle" the flow which had been, at smaller angles, smooth over the upper surface breaks away, the lift decreases, and the drag increases. The stalling angle of an airfoil, as defined above, is 25° or so.

For this invention for an angle-of-attack greater than about 25° the definition of the well known stalling angle of airfoils, recited above, is replaced by the originated definition of this invention, given above in this description, for the angle-of-attack $\alpha$ of a tethered aircraft flying in stall in force equilibrium.

This invention is limited to angles-of-attack for flight in stall which are angles greater than about 25°.

About the Lower Limit of Towing Point Locations

I have discovered, determined, and defined an essential condition for flight of a tethered aircraft in force equilibrium. The condition is that for a tethered aircraft to fly in force equilibrium it is necessary that the distance $\lambda$ from the center-of-gravity cg to the line-of-action of tension T must exceed, be longer than, the distance U from the center-of-gravity cg to the line-of-action of wind-force resultant R, FIG. 10.

Recall the above drawing description, FIG. 10; distance $\lambda$ and distance U are lever arms of the moments around center-of-gravity cg. Again from above, when flight is in force equilibrium the sum of these moments is zero. And, in equilibrium flight, as stated above, FIG. 9, in order to lift weight W, the magnitude of wind-force resultant R exceeds tension T, consequently the moment arm $\lambda$ must exceed, has got to be longer, than the moment arm U for the moment sum to be zero.

The distance U is invarient, constant, it is a property of the aircraft. Quoting further from above cited U.S. Pat. No. 5,533,694, "resultant R remains fixed relative to the structure." So, consequently, resultant R remains fixed at distance U from the center-of-gravity cg, a determinable, fixed point within the structure of the aircraft. Resultant R remains fixed at distance U, however the aircraft is rotated, however the angle-of-attack is changed.

Contrastingly, the distance λ is variable. It varies as the angle-of-attack α is varied, FIG. 10. It is noted that distance λ is the product of the distance U and the quotient of the sines of tether inclination β and the angle-of-attack α.

The sum of the moments about the center-of-gravity cg is zero in force equilibrium flight, then $$U \times R - \lambda \times T = 0$$

or $$\lambda = U \times (R/T)$$

In equilibrium flight, when weight W is lifted, R exceeds T, FIG. 9, so that R/T is greater than 1, $$R/T > 1$$

and so $$\lambda > U$$

Thus, in equilibrium flight, distance λ is greater than distance U.

Recall from the above drawing description, FIG. 11; because both FIG. 10 and FIG. 11 represent flight in force equilibrium, as it is seen in FIG. 10, it is also seen in FIG. 11 that the length of arm λ exceeds that of arm U. Consequently, it is indicated in FIG. 11 that when flight is in force equilibrium, any location of towing-point F, that is necessarily on the action line of tension T, is farther from the center-of-gravity than the perpendicular distance U from the center-of-gravity to the line-of-action of the resultant of the wind forces on the tethered aircraft, the wind-force resultant R. This is an essential condition for flight of a tethered aircraft in force equilibrium that I have discovered, determined, and defined.

Control of the Angle-of-Attack by Towing-Point Manipulation

For each of some, but not all, locations of its towing-point it is the nature of a tethered aircraft, a kite, to fly in stall in force equilibrium at a unique angle-of-attack. Within a limited range of travel of the towing-point the travel causes the aircraft to fly, in a steady wind, from an initial site aloft in the sky to another site aloft where the flight is in force equilibrium at a unique angle-of-attack. In this invention when the aircraft has flown from an initial site aloft, where it may or may not have flown in force equilibrium, to a final site where the aircraft flies in steady wind in stall in force equilibrium the angle-of-attack is controlled.

In a given wind the flight of a tethered aircraft is controlled stock still in midair when the angle-of-attack exceeds the stalling angle and the aircraft flies in force equilibrium.

The angle-of-attack is not controlled when the aircraft does not fly in force equilibrium; then flight is translational and rotational.

In this invention the angle-of-attack of a tethered aircraft is controlled by manipulation of the location of the towing-point relative to the structure of the tethered aircraft, a kite. The towing-point is forced to travel to or fro from location to location. The manipulation is manual or mechanical. The manipulation is initiated at a remote station, remote-control station 12. Output signal $R_S$ of station 12 actuates towing-point driver 8 to propel towing-point transporter 10 to travel towing-point F, on transporter 10, from location to location.

The remotely-selected, remotely-controlled angles-of-attack of this invention correspond to flight between the upper and the lower limits of the angle-of-attack. At angles outside of these limits, flight is either not in stall or not in force equilibrium. Angles outside of these limits are beyond the scope of this invention.

At the upper limit, where flight is in stall, the angle of attack is small; at the lower limit, where flight is in force equilibrium, the angle-of-attack is large.

Locations of the towing-point lie on a path-of-travel. In a particular wind, a set of angles-of-attack, between the limits, corresponds to a set of towing-point locations on the path-of-travel. In another, a different, wind the same set of angles-of-attack corresponds to a different set of towing-points on the path of travel.

So that to maintain an angle-of-attack in gusting and changing winds the location of the towing-point is reset from time to time, either manually or by automatic control. So the location of the towing-point on the path-of-travel is manipulated to control the angle-of-attack.

CONCLUSIONS RAMIFICATIONS AND SCOPE

Thus it is seen that by virtue of having a remotely-selected, remotely-controlled angle-of-attack a tethered aircraft is a tractor that is free of unexpected crashes which are the consequence of towing-point locations passing to the outside of limits for equilibrium flight when winds gust or change velocity. The effects of gusting and changing winds are overcome by the immediate response of the remote control. In times passed kites were employed, with little or no economical success, to tow wagons and boats, because the effort could result in an unexpected crash. In those long ago past times the techniques and apparatus of automatic feedback control did not yet exist.

Thus, also, by virtue of the remote-control it is seen, too, how the objects and advantages of this description are realized. The aircraft is controllable to fly at a constant angle-of-attack in gusting and changing winds. The aircraft is controllable to fly at a constant tether inclination in gusting and changing winds. The aircraft is controllable to change, during flight, an initial angle-of-attack to another angle-of-attack. For greatest pulling force when used as a tractor the aircraft is controllable to fly at less than maximum altitude.

Further advantages include that it is not necessary to land, interrupt a flight, in order to change the towing-point from one location to another. Time aloft and the cost of labor is saved.

A precise definition of the term "angle-of-attack" for a tethered aircraft in stalled, force equilibrium flight is originated. The definition is illustrated in FIG. 12. The definition is that, in force equilibrium flight the initial side of the angle-of-attack is the horizon, a horizontal line, and the terminal side is a perpendicular to the line-of-action of the wind-force resultant, my patent, U.S. Pat. No. 5,533,694.

For a tethered aircraft to fly in force equilibrium, I have discovered that the distance λ from the center-of-gravity to the line-of-action of tether tension T must exceed, be longer than, the distance U from the center-of-gravity to the line-of-action of the resultant R of the wind forces on the aircraft. The location of the action line of the wind forces is determined by the method of my U.S. Pat. No. 5,533,694.

A tethered aircraft will fly in stall at a maximum altitude. The towing-point location for flight at maximum altitude is unique. For flight in stall at maximum altitude the aircraft must have sufficient weight, at least pounds per hundred square feet of wind-catching, supporting surface. If the aircraft is lighter in weight flight will become lifting, circulatory about airfoil like surfaces. Lifting flight is controlled by airplane type deflecting surfaces, whereas this invention includes devices for positioning the towing-point locations for control of stalled flight at angles-of-attack that are greater than the stalling angle. By manipulation of the towing-point location the mechanisms, not before applied, of this invention provide remote control of flight at any angle-of-attack that is greater than the stalling angle.

While my above description contains many specifications, these should not be construed as limitations on the scope of the invention, but rather as an exemplification of preferred embodiments thereof. Many other variations are possible. For example the technique of controlling the angle-of-attack can be a safety feature for towed hang gliders. Accordingly, the scope of the invention should be determined not by the embodiments illustrated, but by the appended claims and their legal equivalents.

What is claimed is:

1. A tethered aircraft having a remotely-controlled angle-of-attack at which said angle-of-attack said aircraft flys in stall in force equilibrium comprising:

(a) moveable transporter means for having the tether secured to said transporter means at the towing-point on said transporter means that is guidedly secured to the structure of said aircraft, and (b) locations of said towing-point that are farther from the center-of-gravity of said aircraft than the perpendicular distance from said center-of-gravity to the line-of-action of the resultant of the wind forces on said aircraft, and (c) towing-point driver means on-board said aircraft, supported by said structure, for forcing said transporter means, that is connected to said driver means, to travel said towing-point, thereon said transporter means, from an initial location relative to said structure to a final location relative to said structure, and (d) remote-control station means on-the-ground, or on another aircraft aloft, or remotely on the same said aircraft aloft, for receiving selected, angle-of-attack, operational inputs, and (e) said remote-control station means having means for generating, consequently to selection of angle-of-attack operational inputs, output signals that correspondingly to said selected angle-of-attack actuate said on-board towing-point driver means to travel said towing-point to said final location relative to said structure whereby said aircraft will fly away from an initial site aloft in the sky to a final said site aloft where it flys in stall in force equilibrium controlled at said selected angle-of-attack when said towing-point, thereon said transporter means, is driven by said towing-point driver means from said initial location to said final location relative to said structure of said tethered aircraft; when said towing-point is travelled faster from said towing-point's said initial location to its said final location than the flight of said aircraft, said aircraft will arrive later in time at its final said site than the time of arrival of said towing-point at its said final location.

2. The tethered aircraft having remotely-controlled angle-of-attack of claim 1 wherein said towing-point driver means includes:

(a) motor means for propelling said transporter means, and (b) power-source means for energizing said towing-point driver means, and (c) actuator means for controlling said towing-point driver means.

3. The tethered aircraft having remotely-controlled angle-of-attack of claim 1 wherein said towing-point transporter means includes slideable, rigid beam means that is connected to said towing-point driver means and that is secured to said tethered aircraft by slide-through guides, said beam means having said towing-point thereon, with said tether fastened thereto said towing-point, said beam means for carrying said towing-point back or forth from said initial location to said final location while said towing-point driver means propels said transporter means against opposing forces.

4. The tethered aircraft having remotely-controlled angle-of-attack of claim 1 wherein said towing-point transporter means includes rigid, curved rail means fixedly supported from said structure of said aircraft, said rail means for having slide means captured by and freely moveable along said rail means, said slide means for having said towing-point thereon with said tether fastened thereto said towing-point, said slide means further for carrying said towing-point back or forth from said initial location to said final location correspondingly to the curve of said rail means while said towing-point driver means propels said transporter means against opposing forces via flexible-jointed connecting-rod means for imparting motion to said slide means along said rail means, said connecting rod means is interconnecting means between said slide means and said towing-point driver means.

5. The tethered aircraft having remotely-controlled angle-of-attack of claim 1 wherein said towing-point transporter means includes flexible belt means deployed around plural pulley means for supporting said belt means, said pulley means mounted on shafts that are supported on the structure of said tethered aircraft, said belt means for having said towing-point means fixed on the windward part of said belt means with said tether fastened thereto said towing-point, said belt means further for carrying said towing-point back and forth from said initial location to said final location while said towing-point driver means rotates at least one of said pulleys that is a drive pulley to propel said transporter means against opposing forces.

6. The tethered aircraft having remotely-controlled angle-of-attack of claim 1 wherein automatic feedback control of said remotely-controlled angle-of-attack is further included which said feedback control is comprised of:

(a) angle-of-attack sensor means, mounted on board the structure of said aircraft, for measuring and signaling the measured value of said angle-of-attack to signal comparator means, and (b) signal comparator means, on-board or on-the-ground, for measuring the difference between the signal representing said measured value of said angle-of-attack and the output signal from said remote-control station that represents values of said selected angle-of-attack that are operationally input to said remote-control station, and (c) automatic controller means, on-board or on-the-ground, for receiving and functionally responding to the output signal from said comparator means by producing an output signal for actuation of said towing-point driver means whereby said selected angle-of-attack is automatically controlled in gusting and changing winds.

7. A tethered aircraft having a remotely-controlled angle-of-attack at which said angle-of-attack said aircraft flys in stall in force equilibrium comprising:

(a) said tethered aircraft having one or a plurality of flexible, wind-deflecting, equivalently-planar surfaces, and (b) flexible-surface driver means on-board said aircraft, supported by the structure of said aircraft, for modulating the attitude, relative to the wind-flow, of said flexible, wind-deflecting, equivalently-planar surfaces, and (c) power transmission means for imparting motion from said flexible-surface driver means to said flexible, wind-deflecting, equivalently-planar surfaces, and (d) remote-control station means on-the-ground, or on another aircraft aloft, or remotely on the same said aircraft aloft, for receiving selected, angle-of-attack, operational inputs, and (e) said remote-control station means having means for generating, consequently to selection of angle-of-attack operational inputs, output signals that correspondingly to said selected angle-of-attack actuate said on-board flexible-surface driver means to modulate the attitude, relative to the wind-flow, of said flexible, wind-deflecting, equivalently-planar surfaces whereby said aircraft will fly away from an initial site aloft in the sky to a final site aloft where it flys in stall in force equilibrium controlled at a selected angle-of-attack when said flexible, wind-deflecting, equivalently-planar surface is modulated by said flexible-surface driver means; when said flexible, wind-deflecting, equivalently-planar surface is modulated faster than the flight of said aircraft, said aircraft will arrive later in time at its final site aloft than the time of completion of the modulation.

8. The tethered aircraft having remotely-controlled angle-of-attack of claim 7 wherein said flexible-surface driver means includes:

(a) motor means for propelling said flexible, wind-deflecting, equivalently-planar surfaces, and (b) power-source means for energizing said flexible-surface driver means, and (c) actuator means for controlling said flexible-surface driver means.

* * * * *

UNITED STATES PATENT AND TRADEMARK OFFICE

CERTIFICATE OF CORRECTION

PATENT NO. : 5,931,416
DATED : August 3, 1999
INVENTOR(S) : Howard G. Carpenter

It is certified that error appears in the above-identified patent and that said Letters Patent is hereby corrected as shown below:

The title page, showing the illustrative figure, should be deleted and substitute therefor the attached title page.

The drawing sheets, consisting of Figs 1-7, should be deleted to be replaced with drawing sheets consisting of Figs. 1-7, as shown on the attached pages.

Signed and Sealed this
Fourth Day of January, 2000

*Attest:*

*Attesting Officer*

*Acting Commissioner of Patents and Trademarks*

United States Patent [19]

Carpenter

[11] Patent Number: 5,931,416

[45] Date of Patent: Aug. 3, 1999

[54] TETHERED AIRCRAFT HAVING REMOTELY CONTROLLED ANGLE OF ATTACK

[76] Inventor: Howard G. Carpenter, 7667 Kelley Dr., Apt. 13, Stockton, Calif. 95207

[21] Appl. No.: 08/976,125

[22] Filed: Nov. 21, 1997

[51] Int. Cl.[6] ..... A63H 27/08

[52] U.S. Cl. ..... 244/155 A

[58] Field of Search ..... 244/155 A, 153 R

[56] References Cited

U.S. PATENT DOCUMENTS

| | | | |
|---|---|---|---|
| 2,556,877 | 6/1951 | Howard | 244/155 R |
| 2,696,960 | 12/1954 | Howard | 244/155 A |
| 3,735,949 | 5/1973 | Theis, Jr. | 244/155 A |
| 3,770,230 | 11/1973 | Johnston | 244/155 A |
| 4,280,675 | 7/1981 | Davis et al. | 244/155 A |
| 5,533,694 | 7/1996 | Carpenter | 244/153 R |

*Primary Examiner*—Charles T. Jordan
*Assistant Examiner*—Patricia L. Zuniga

[57] ABSTRACT

A remote-control maintains the angle-of-attack of a tethered aircraft in fluxuating wind velocity. The tether is attached to the towing-point that is on a motor-driven tether-transporter. The transporter is secured to the structure of the aircraft. The angle-of-attack is modulated when actuating signals from a remote station cause the motor to propel the transporter, which carries the towing-point, to or fro, across the windward face of the aircraft.

8 Claims, 7 Drawing Sheets

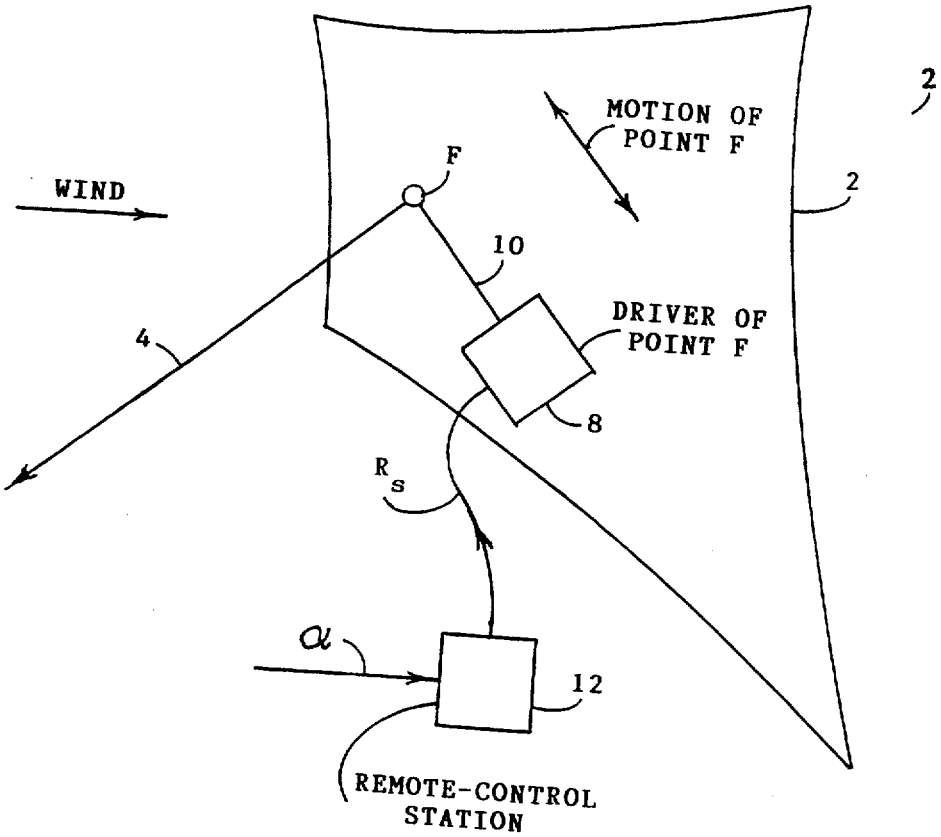

FIG. 6
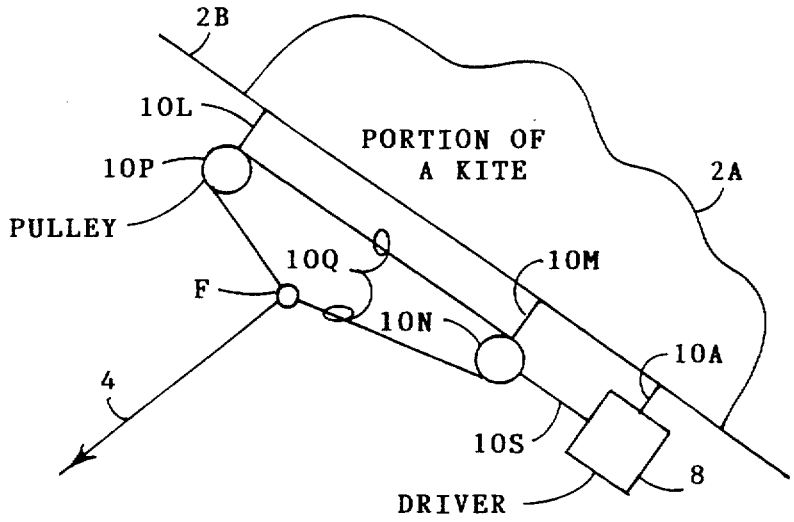
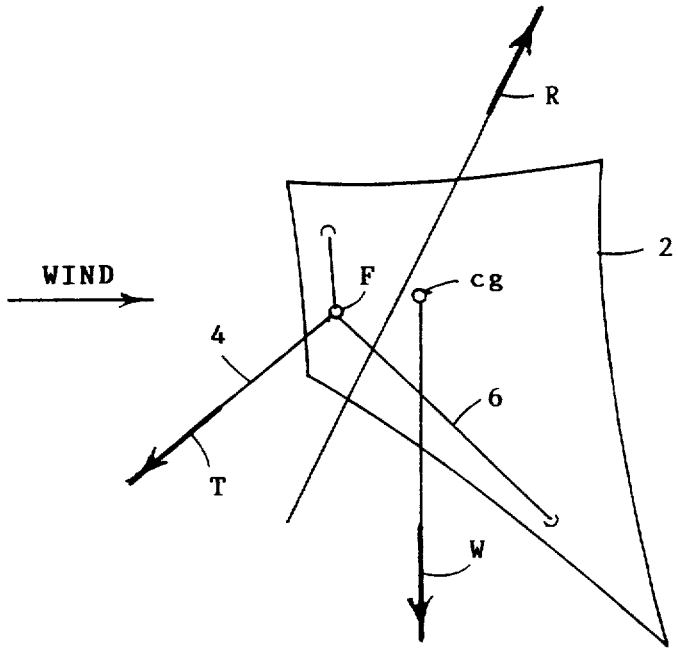
FIG. 7
--PRIOR ART--